US012012741B2

(12) United States Patent
Slish

(10) Patent No.: US 12,012,741 B2
(45) Date of Patent: Jun. 18, 2024

(54) FRENCH DRAIN DRAINPIPE

(71) Applicant: IRONX PIPING LLC, Selkirk, NY (US)

(72) Inventor: Richard A. Slish, Selkirk, NY (US)

(73) Assignee: IRONX PIPING LLC, Selkirk, NY (US)

( * ) Notice: Subject to any disclaimer, the term of this patent is extended or adjusted under 35 U.S.C. 154(b) by 0 days.

(21) Appl. No.: 17/985,318

(22) Filed: Nov. 11, 2022

(65) Prior Publication Data

US 2024/0159036 A1 May 16, 2024

(51) Int. Cl.
*E02B 11/00* (2006.01)
*E03F 3/02* (2006.01)

(52) U.S. Cl.
CPC ..... *E03F 3/02* (2013.01); *E02B 11/005* (2013.01)

(58) Field of Classification Search
CPC ..... E02B 11/005; F16L 9/22; E03F 3/043
USPC ..... 405/36, 39–41, 43–45, 47–49
See application file for complete search history.

(56) References Cited

U.S. PATENT DOCUMENTS 2,035,313 A 10/1934 Griffin
2,366,522 A * 1/1945 Gutman ..... E02B 11/005 405/47
3,936,380 A 2/1976 Boske
4,596,491 A 6/1986 Dietzler
6,887,383 B2 5/2005 Potts
7,309,423 B1 12/2007 Branz
7,909,535 B2 3/2011 Samara
8,002,496 B2 8/2011 Giuffré
2006/0086377 A1* 4/2006 Showler ..... B08B 9/0321 134/22.12
2008/0226393 A1 9/2008 Leun

FOREIGN PATENT DOCUMENTS

CA 2292345 * 6/2000
FR 2340416 A1 * 9/1977

OTHER PUBLICATIONS

FR-2340416 machine translation, pp. 3 (Year: 1977).*

* cited by examiner

*Primary Examiner* — Sunil Singh
(74) *Attorney, Agent, or Firm* — Jong Patent Firm; Cheng Ning Jong; Tracy P. Jong

(57) ABSTRACT

A French drain drainpipe with built-in means for flushing iron ocher out of the drainpipe, out of the perforations, and out of the gravel surrounding the drainpipe. Said means may include chambers for receiving pressurized washing fluids and exit orifices from the chambers. Fittings are provided for connecting the chambers to a pressurized source of washing fluids, such as hose fittings for connecting to a normal household water supply.

3 Claims, 11 Drawing Sheets

FRENCH DRAIN DRAINPIPE

TECHNICAL FIELD

The present invention relates to an improved perforated pipe for French drain systems.

BACKGROUND OF THE INVENTION

A French drain is a trench filled with gravel and having a perforated pipe embedded in the gravel to collect and redirect surface water and groundwater away from an area. French drains are often installed around a building's foundation on the external side of the foundation wall and/or under the basement floor on the internal side to prevent water from penetrating or damaging the foundation. Perforations along the pipe's length allow water to flow into the pipe. The pipe is typically pitched so the inflow water flows down the pipe to a point where it is discharged. The pipe forms an interior channel below the perforations, which channel is continuous, i.e., has continuous unbroken surfaces that confine the inflow water within the channel as it flows to the point of discharge, which discharge is typically through an open end of the pipe.

Over time, iron ocher—an orange-brown gelatinous deposit—may build up in and clog the pipe, pipe perforations and the gravel around the pipe. Iron ocher is a waste byproduct of oxidation of iron in groundwater by bacteria that is naturally occurring in soil.

Clogging from iron ocher can lead to under-performance or failure of the drainage system.

There is a need for a French drain drainpipe adapted for removal of iron ocher. The present invention fulfills these needs by providing means for flushing iron ocher out of the drainpipe, out of the perforations, and out of the gravel surrounding the drainpipe.

SUMMARY OF THE INVENTION

In a first aspect, the present invention provides a French drain drainpipe, comprising: a pipe wall; the wall defining a continuous drainage channel; an opening through the wall for passage of fluid through the wall into the drainage channel; and a first chamber for receiving wash fluid, said first chamber having a first orifice for discharge of wash fluid to the drainage channel.

In a second aspect, the present invention provides a French drain drainpipe, comprising: a pipe wall; the wall defining a continuous drainage channel; an opening through the wall for passage of fluid through the wall into the drainage channel; and a first chamber for receiving wash fluid, said first chamber having a first orifice for discharge of wash fluid exterior of the pipe.

In a third aspect, the present invention provides a French drain, comprising: a perforated pipe; a built-in conduit for receiving wash fluid; said conduit comprising an outlet for discharging wash fluid into said perforated pipe.

In a fourth aspect, the present invention provides a French drain, comprising: a perforated pipe defining a pipe interior and exterior; a built-in conduit for receiving wash fluid; said conduit comprising an outlet for discharging wash fluid exterior of said perforated pipe.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings and photographs in which:

DETAILED DESCRIPTION OF THE INVENTION

Figure 1:
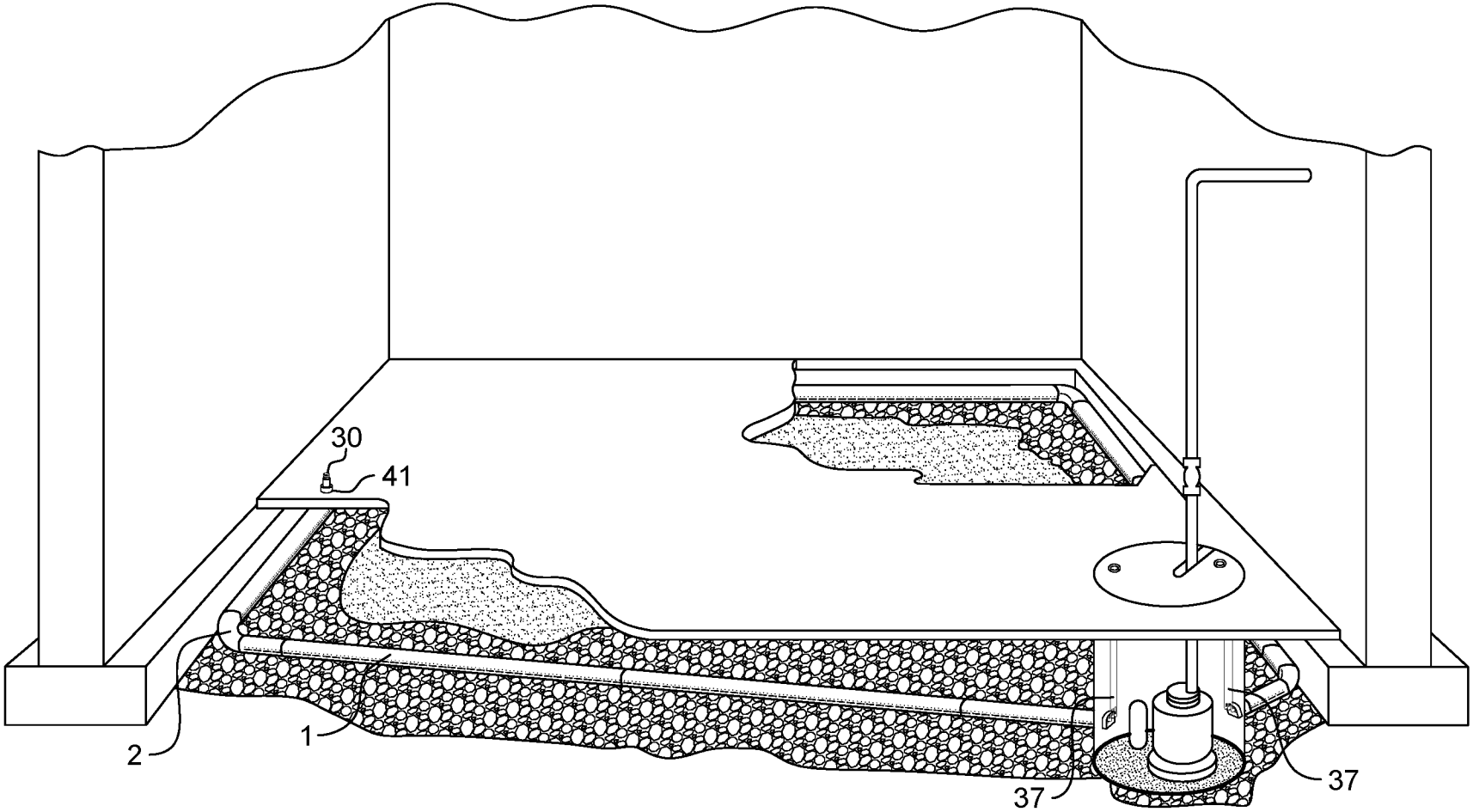
FIG. 1 is a pictorial view of a French drain system of the present invention.

With reference to FIG. 1, a French drain with the perforated pipe of the present invention is shown installed under the basement floor of a building on the internal side the foundation wall. The building may be residential, commercial, industrial, civic, or any other type. The French drain is sloped downward toward the sump pump well. Water may flow into the pipe through sidewall perforations 25 (FIG. 3), down the pipe, and into the sump pump well.

With reference to FIGS. 1, the perforated pipe may comprise pipe segments 1 that are abutted end to end. The drainage system may comprise one or more ports 41 through the floor and hose fittings 30 through said ports and may further comprise hose fittings 37 through the sump pump well. Said hose fittings may receive a water hose, and provide a connection of the hose to the pipe so that pressurized water from the hose may flush the pipe.

The pressurized water may be from any source, such as a reservoir or tank and under any means of pressure, such as a compressor, pump or natural pressure head, such as a normal household water supply.

Figure 2:
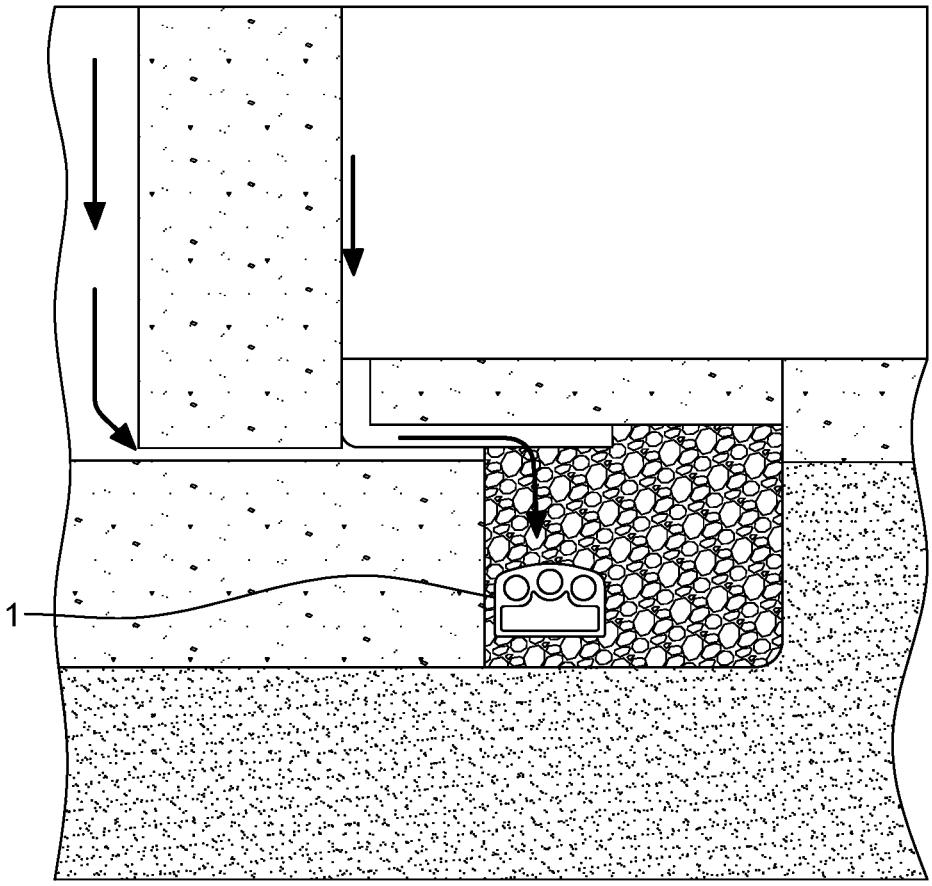
FIG. 2 is a cross-section view of the French drain system of FIG. 1.

With reference to FIG. 2, a cross section of the French drain system of FIG. 1 shows the improved drainpipe of the present invention embedded in the gravel.

With reference to FIGS. 3 and 5-7, the pipe segment 1 may have a tenon 11 on one end and a mortise recess on the other end 12. Adjacent pipe segments may be connected together by inserting the tenon of one pipe segment into the mortise recess of an adjacent pipe segment. A plurality of pipe segments may be connected in series to form long stretches of pipe.

Pipe segment 1 may have an interior drainage channel 20 defined by interior peripheral surface 26 pipe wall 15. The pipe wall may have one or more perforations 25 therethrough so that water may flow from outside the pipe through the perforations into channel 20. Said flow of water into the pipe may be referred to herein as "inflow." Perforations 25 may be at an elevation above the bottom of drainage channel 20 so that below the perforations the channel is continuous and unbroken so that it may confine the water within the channel as it flows towards its discharge through the open end of the pipe. The pipe is preferably pitched with one end of the pipe lower than the other end so that inflow water will flow down the drainage channel towards the low end. The pipe is preferably open ended so water may be discharged through the open end.

Figure 5:
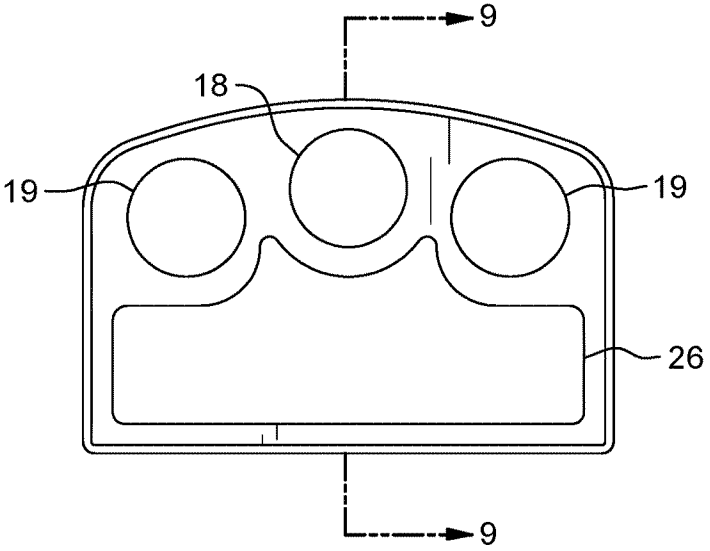
FIG. 5 is an end plan view of the right end of the drainpipe segment of FIG. 3.
Figure 6:
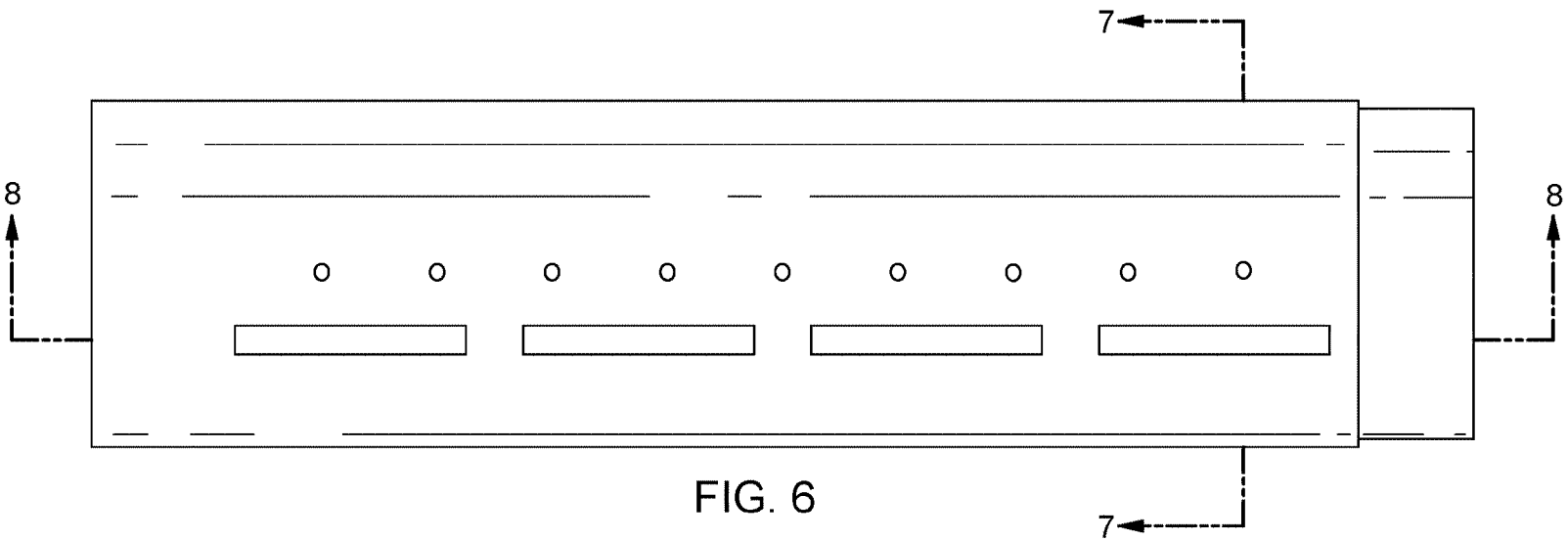
FIG. 6 is a side plan view of the drainpipe segment of FIG. 3.
Figure 7:
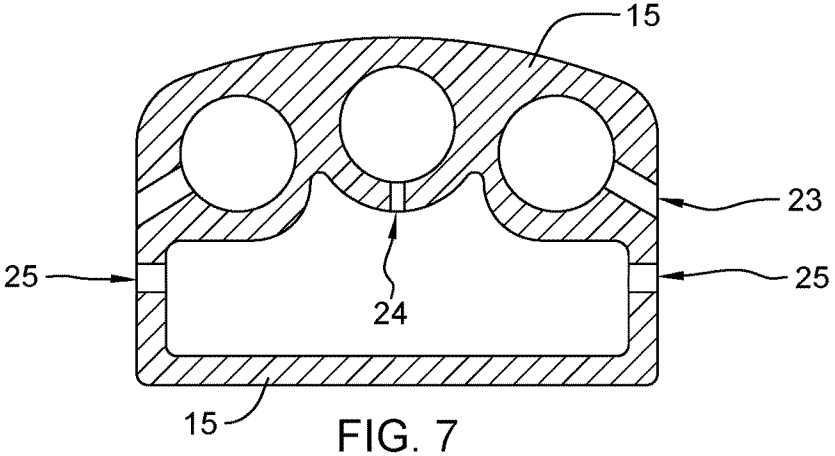
FIG. 7 is a cross-section view on section plane 7-7 of FIG. 6.
Figure 8:
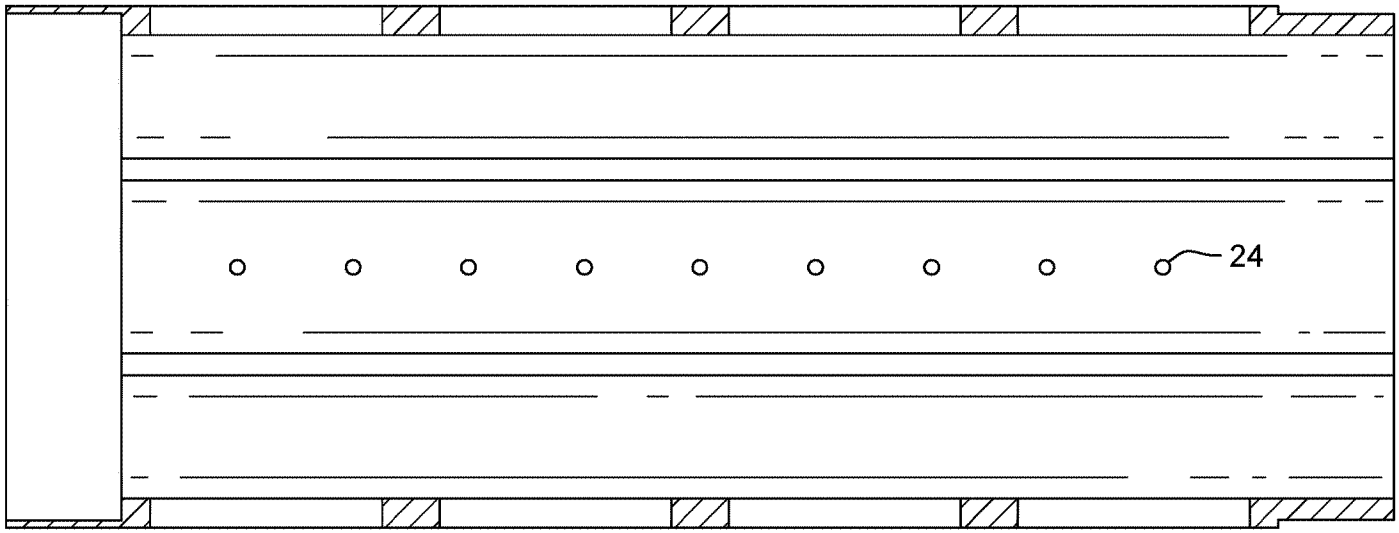
FIG. 8 is a cross-section view on section plane 8-8 of FIG. 6.
Figure 9:
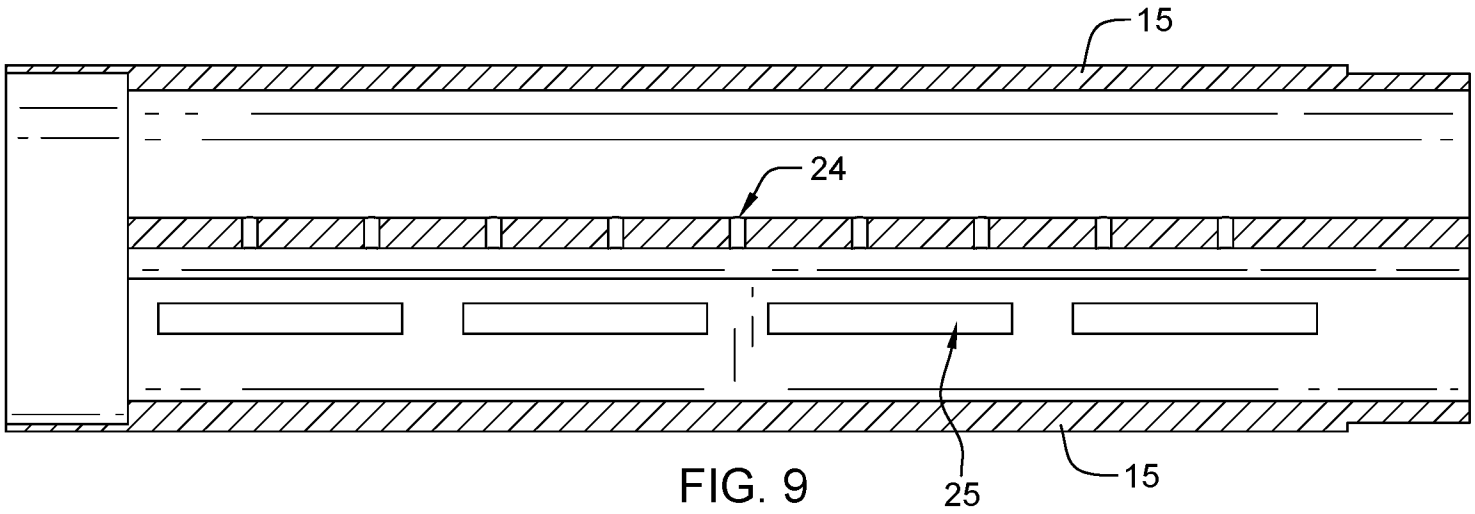
FIG. 9 is a cross-section view on section plane 9-9 of FIG. 5.

The pipe may further comprise one or more side conduits 22 for receiving pressurized water for flushing iron ocher out of the gravel adjacent to the exterior of the pipe. In a preferred embodiment, conduit 22 is integral to pipe wall 15 and is defined by interior peripheral surface 19 (FIG. 5). The pipe wall may have one or more pressure wash orifices 23 (FIG. 7) that extend through the wall from conduit surface 19 to the exterior surface of the pipe. Said orifices 23 provide passageway for pressurized water to flow from conduit 22 to the exterior of the pipe for flushing away iron ocher that may accumulate in the gravel adjacent to the pipe. Preferably, orifice outlets are proximal to perforations 25 so that the discharge of pressurized water washes iron ocher away from areas adjacent to the perforations to keep the perforations free of iron ocher accumulation. In the preferred embodiment of FIGS. 3, 6 and 7, orifices 23 exit the pipe wall above perforations 25 and are sloped downward so that the pressurized water is directed downward towards the gravel adjacent to the perforations.

With reference to FIGS. 3-8, the pipe may further comprise one or more inner conduits 21 for receiving pressurized water for flushing iron ocher out of drainage channel 20. In a preferred embodiment, conduit 21 is integral to pipe wall 15 and is defined by interior peripheral surface 18 (FIG. 5). The pipe wall may have one or more pressure wash orifices 24 (FIGS. 7 and 8) that extend through the wall from interior peripheral surface 18 to the interior of wall 15 above channel 20.

Said orifices 24 provide passageway for pressurized water to flow from conduit 21 to channel 20 for washing away iron ocher that may accumulate in the channel.

The pipe segments may be of unitary construction comprising integral conduits and may be manufactured via any suitable means such as injection molding, extrusion molding, 3D printing, machining of a single workpiece, or otherwise. In an alternate embodiment, conduits 21 and 22 may be of separate tubular structure, such as a pipe or hose. Said tubular structure may be attached to the pipe and may have outlet orifices through the separate tube wall. Said tubular structure may be statically attached to the pipe so that it remains in fixed relation to the pipe. Whether of unitary construction or separate attached construction, the conduits may be referred to herein as "built-in" conduits.

Figure 3:
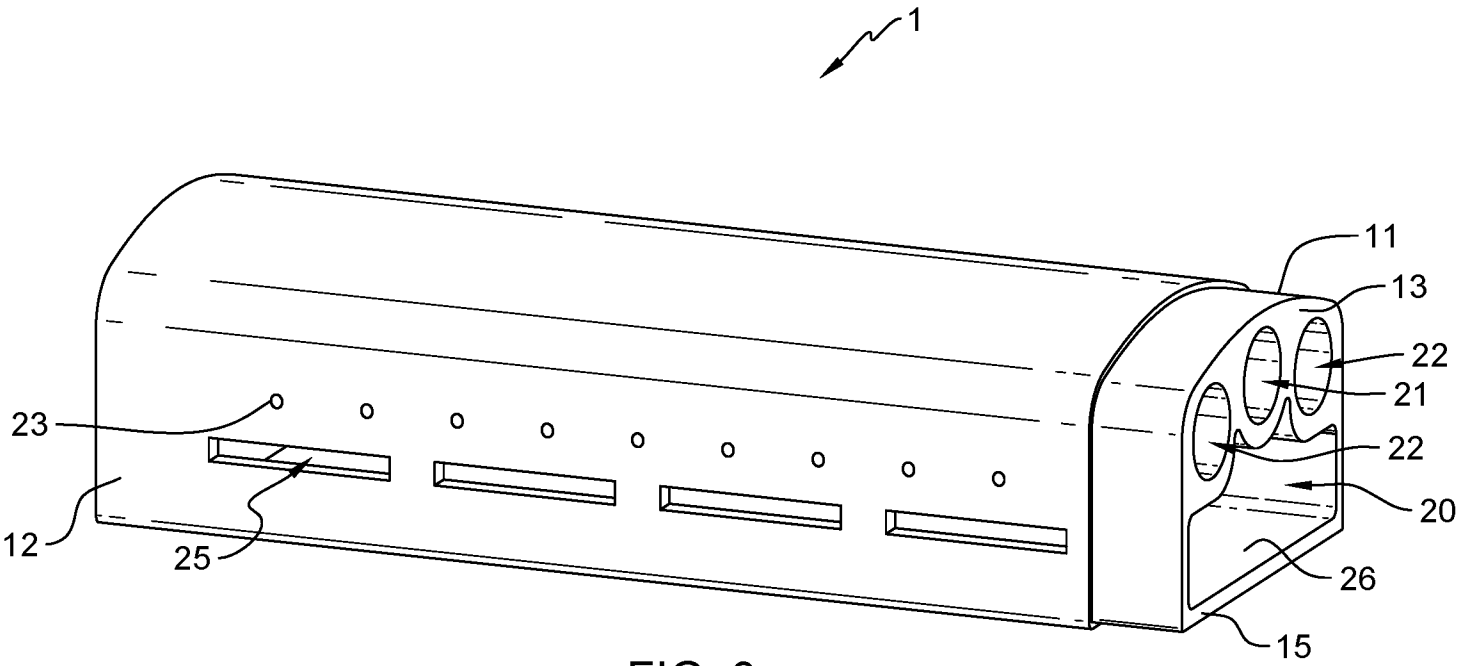
FIG. 3 is a pictorial view of a short straight segment of drainpipe of the present invention showing a male (or tenon) end of the drainpipe segment.
Figure 4:
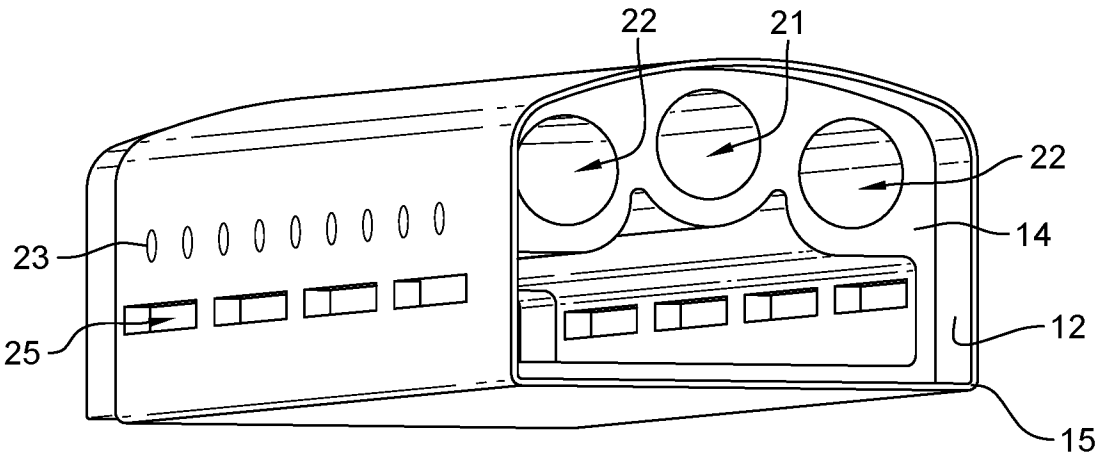
FIG. 4 is a pictorial view of a short straight segment of drainpipe of the present invention showing a female (or mortise) end of the drainpipe segment.

With reference to FIGS. 1, 3 and 4, the perforated pipe may comprise a plurality of adjacent pipe segments 1 abutted end-to-end so that front-end surface 13 of tenon 11 a first segment 1 abuts recessed back-end surface 14 of an adjacent segment 1.

Figure 13:
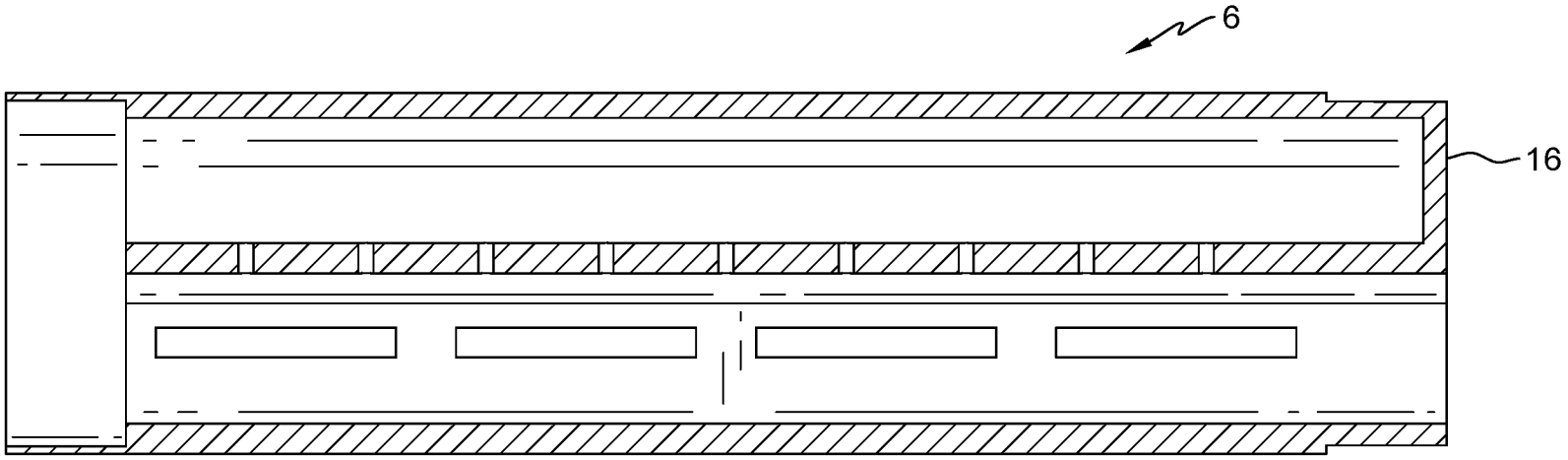
FIG. 13 is an alternate embodiment of the drainpipe segment of FIG. 3 in which the right end of the pressure wash lines are capped off.
Figure 14:
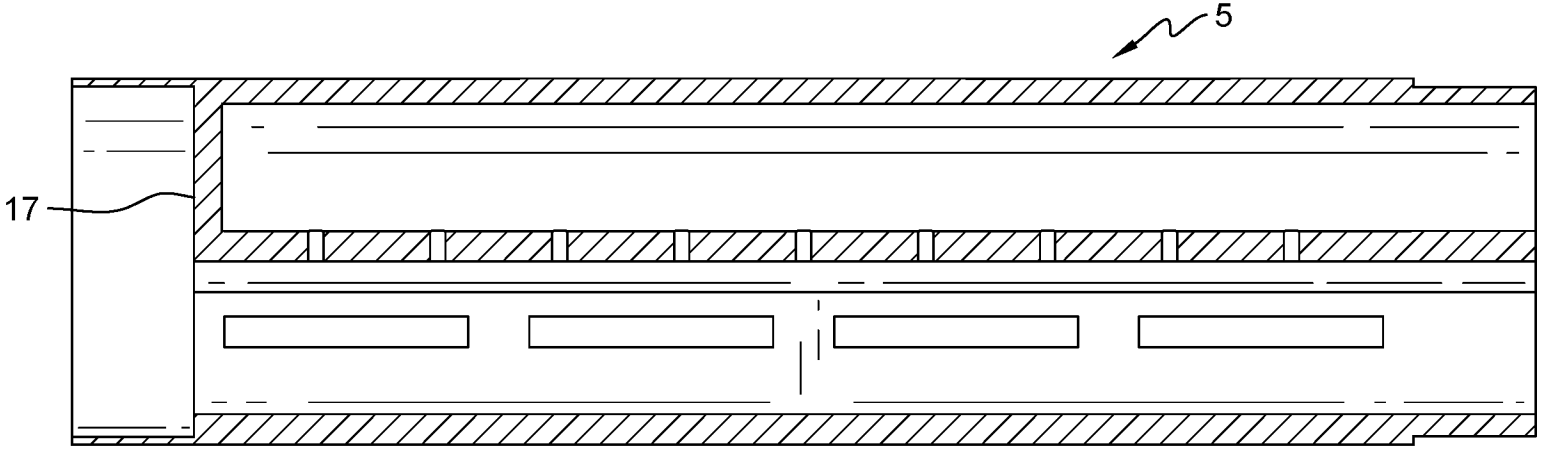
FIG. 14 is an alternate embodiment of the drainpipe segment of FIG. 3 in which the left end of the pressure wash lines are capped off.

With reference to FIG. 13, a pipe segment 6 may be provided with one or more of conduits 21 and 22 closed off at the tenon end with an end wall 16. With reference to FIG. 14, a pipe segment 5 may be provided with one or more of conduits 21 and 22 closed off at the mortise end with an end wall 17.

Figure 11:
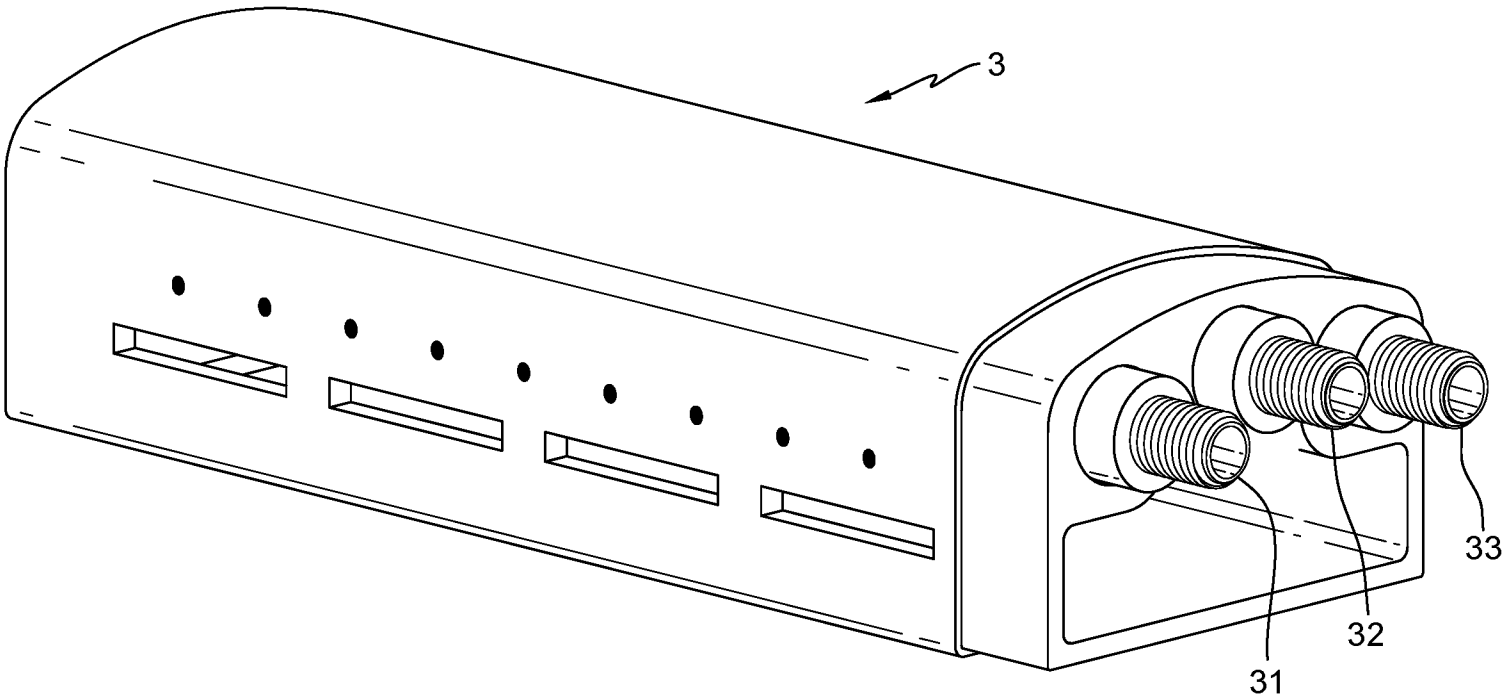
FIG. 11 is the drainpipe segment of FIG. 3 with three hose fittings extending from the end of the drainpipe and communicating with the three pressure wash lines.
Figure 12:
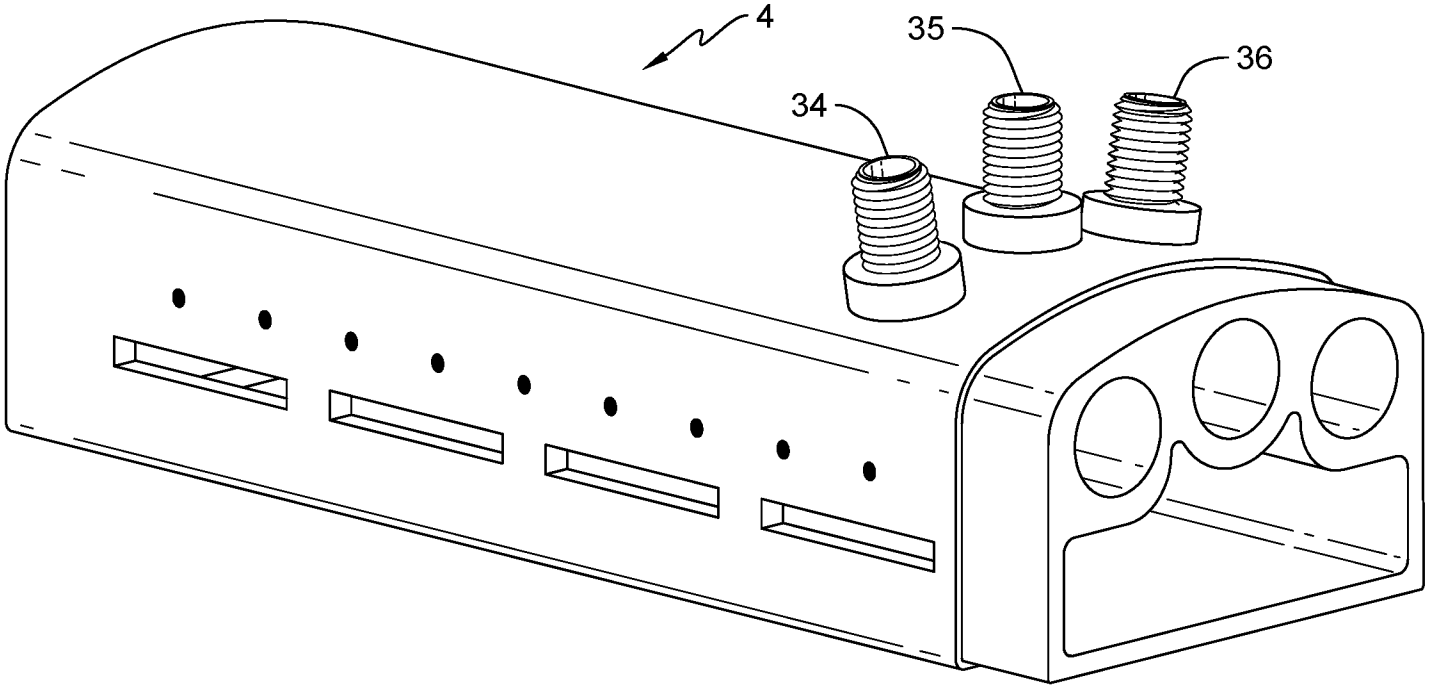
FIG. 12 is the drainpipe segment of FIG. 3 with three hose fittings extending from the top of the drainpipe and communicating with the three pressure wash lines.

In alternate embodiments to those shown in FIGS. 13 and 14, pipe segments 5 and 6 may be provided with hose fittings mid-span of the pipe as shown on pipe segment 4 in FIG. 12. Alternatively, or in addition to said mid-span pipe fittings, pipe fittings may be provided on segments 5 and 6 at the mortise end or tenon end as shown on the tenon end of pipe segment 3 in FIG. 11.

Figure 10:
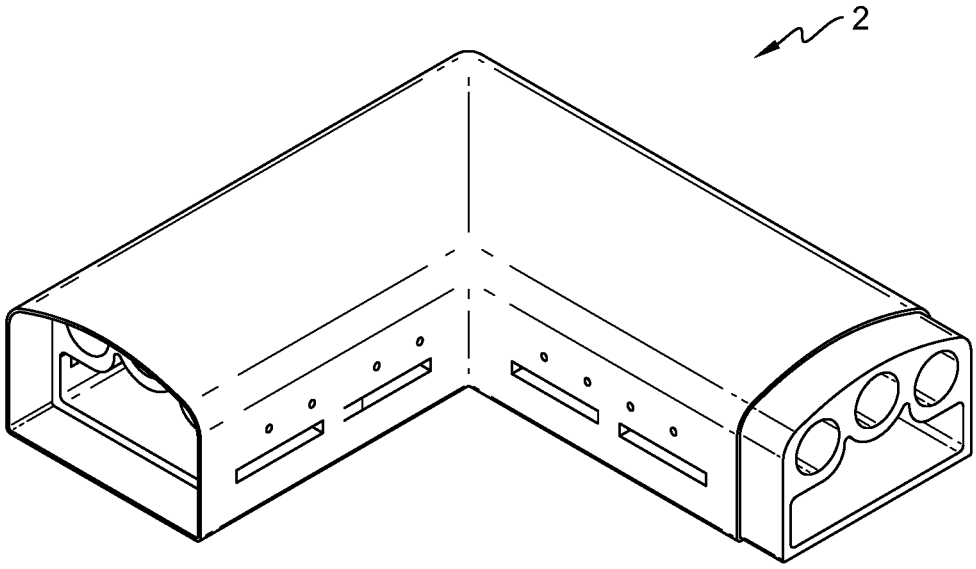
FIG. 10 is a pictorial view of a corner segment of drainpipe of the present invention.

With reference to FIG. 10, pipe segment 2 is shaped in a right angle. Pipe segments may alternatively be provided in any shape. Any pipe segment may be provided with any combination of mid-span hose fittings, end hose fittings, and conduit end-walls.

Pipe segments 1, 2, 3, 4, 5 and 6 may be assemble in any sequence. For example, a plurality of pipe segments 1 assembled end-to-end form uninterrupted open-ended drainage channel 20 and uninterrupted open-ended pressure wash conduits 21 and 22 for the length of the assembly. For another example, pipe segments 5, 1 and 6 assembled in that order form uninterrupted open-ended drainage channel 20 and closed-ended pressure wash chamber comprising conduits 21 and 22 uninterrupted for the length of the assembly except for the closed ends. The closed-ended pressure wash conduits have finite length, and pressurized water introduced into the conduits through the hose fittings will have a finite number of orifices to discharge through. For a given pressure and flow capacity of the pressurized water supply, a fewer number of orifices of a given size may result in greater rate of discharge volume through the orifices, which may result in more effective flushing of iron ocher along the length of the assembly. Pipe segments may be provided at any length and at the same length or different length than any other pipe segment.

The quantity, lengths and varieties of pipe segments assembled together in a French drain system may be chosen from a variety as desired to meet the needs of the drain system and to achieve desired orifice discharge flow rate for flushing away of iron ocher. For example, pipe segments may be chosen to form a series of closed-ended pressure wash chambers of finite length with separate hose fittings provided for each chamber in the series. For another example, pipe segments may be chosen to form uninterrupted open-ended drainage channel 20 and uninterrupted open-ended pressure wash conduits 21 and 22 for the entire length of the assembly, with the conduits being closed only at the ends of the piping assembly.

Flushing away of gelatinous iron ocher external to the drainpipe may be accomplished at low pressure and low flow velocity that will not disturb the stone or gravel surrounding the drainpipe. Additives, such as chemical additives may be added to the water to improve flushing performance.

In alternative to sealing off the ends of conduits with integral end walls like those shown in pipe segments 5 and 6 of FIGS. 13 and 14, separate plugs (not shown) may be provided for insertion into and sealing off open ended conduits of pipe segments 1 and 2 of FIGS. 3-10. Plugs may be used to form a series of closed-ended pressure wash chambers of finite length with segment types selected so that each chamber in the series may have separate hose fittings. Alternatively, a conduit may be sealed at one end with a wall and at the other with a plug.

In addition to or alternatively to flushing, the improved French drain of the present invention may be used to chemically treat the French drain with chemical additives that may be mixed with fluid and distributed throughout the French drain via the conduits. Such treatments may be performed at much lower water pressure and flow rates than might be used for flushing operations. Flushing, or chemical treatment, or a combination thereof may be used to clean the drainpipe. The present invention may be used for cleaning other materials from within and around the drainpipe, including any materials that may be removed by flushing, chemical treatment, or a combination thereof. The terms "wash fluid" or "washing fluid" as may be used herein refer to fluid introduced into chambers 21 or 22, under pressure or not under pressure, for discharge interior of the pipe or exterior of the pipe for the purposes of flushing, washing, chemically treating or for other purposes. Said purposes may be referred to herein collectively or individually as "washing" or to "wash."

The in-place structure, accessibility, efficiency, affordability, simplicity of operation and other characteristics of the built-in flushing means provided by the improved French drain of the present invention promotes regular flushing and/or chemical treatment of iron ocher from the system and makes the same practical.

While the invention has been particularly shown and described with reference to certain embodiments, it will be understood by those skilled in the art that various changes in form and details may be made to the invention without departing from the spirit and scope of the invention as described in the following claims.

I claim:

1. A French drain drainpipe, comprising:

a pipe wall defining a continuous drainage channel, said pipe wall comprising an interior side defining a pipe interior and an exterior side defining a pipe exterior;

an opening through the pipe wall for passage of fluid through the pipe wall into the continuous drainage channel;

a first chamber for receiving a first source of wash fluid, said first chamber comprising a first orifice for discharge of the first source of wash fluid to the continuous drainage channel, said first chamber comprises a plurality of chamber segments, each said chamber segment having a first end closure and a second end closure and each said chamber segment connectable to the first source of wash fluid; and a first fitting for connecting the first chamber to the first source of wash fluid.

2. The French drain drainpipe of claim 1, further comprising a second chamber for receiving a second source of wash fluid, said second chamber having a second orifice for discharge of the second source of wash fluid to the pipe exterior.

3. The French drain drainpipe of claim 2, further comprising:

a second fitting for connecting the second chamber to the second source of wash fluid.

* * * * *